US011585205B2

(12) United States Patent
Neufeldt et al.

(10) Patent No.: US 11,585,205 B2
(45) Date of Patent: Feb. 21, 2023

(54) METHODS, SYSTEMS, AND MEDIA FOR CONTROLLING A TOOLFACE OF A DOWNHOLE TOOL

(71) Applicant: Pason Systems Corp., Calgary (CA)

(72) Inventors: Adam Chase Neufeldt, Calgary (CA); Brian James Eley, Calgary (CA); Thomas William Charles Wilson, Calgary (CA)

(73) Assignee: PASON SYSTEMS CORP., Calgary (CA)

( * ) Notice: Subject to any disclaimer, the term of this patent is extended or adjusted under 35 U.S.C. 154(b) by 146 days.

(21) Appl. No.: 17/147,037

(22) Filed: Jan. 12, 2021

(65) Prior Publication Data

US 2022/0106865 A1 Apr. 7, 2022

(30) Foreign Application Priority Data

Oct. 6, 2020 (CA) ..... CA 3095505

(51) Int. Cl.
*E21B 44/04* (2006.01)

(52) U.S. Cl.
CPC ..... *E21B 44/04* (2013.01)

(58) Field of Classification Search
CPC ..... E21B 44/00; E21B 44/005; E21B 44/02; E21B 44/04; E21B 44/06
See application file for complete search history.

(56) References Cited

U.S. PATENT DOCUMENTS

| | | | |
|---|---|---|---|
| 6,050,348 | A | 5/2000 | Richardson et al. |
| 6,918,453 | B2 | 7/2005 | Haci et al. |
| 7,096,979 | B2 | 8/2006 | Haci et al. |
| 7,152,696 | B2 | 12/2006 | Jones |
| 7,588,099 | B2 | 9/2009 | Kracik |
| 7,823,655 | B2 | 11/2010 | Boone et al. |
| 10,036,678 | B2 | 7/2018 | Fisher, Jr. et al. |
| 10,190,402 | B2 | 1/2019 | Dykstra et al. |
| 10,358,904 | B2 * | 7/2019 | Kyllingstad ..... G06F 30/17 |

(Continued)

FOREIGN PATENT DOCUMENTS

| | | |
|---|---|---|
| CA | 2525382 A1 | 11/2004 |
| CA | 2525371 A1 | 12/2004 |

(Continued)

OTHER PUBLICATIONS

"Well Engineers Notebook", Shell International Exploration and Production B.V., Feb. 1998, 4th Edition, May 2003, pp. L20-L21.

(Continued)

*Primary Examiner* — Frederick L Lagman
(74) *Attorney, Agent, or Firm* — D'Ambrosio & Menon, PLLC; Usha Menon

(57) ABSTRACT

There is described a method of determining a reactive torque factor for use in controlling a toolface of a downhole tool. For each of one or more sliding operations, a change in a top drive position of a drive unit operable to rotate a drill string connected to the downhole tool is determined, a change in a toolface of the downhole tool is determined, and a change in a differential pressure is determined. Based on the change in the top drive position, the change in the toolface, and the change in the differential pressure, a reactive torque factor is determined.

22 Claims, 8 Drawing Sheets

(56) References Cited

U.S. PATENT DOCUMENTS

| | | | | |
|---|---|---|---|---|
| 10,612,307 | B2 * | 4/2020 | Summers | E21B 44/04 |
| 10,830,033 | B2 * | 11/2020 | Weideman | E21B 44/00 |
| 10,954,773 | B2 * | 3/2021 | Benson | E21B 44/04 |
| 2002/0104685 | A1 | 8/2002 | Pinckard et al. | |
| 2004/0211596 | A1 * | 10/2004 | Huang | E21B 44/00 175/38 |
| 2017/0037722 | A1 * | 2/2017 | Jeffryes | E21B 4/02 |
| 2017/0306702 | A1 * | 10/2017 | Summers | E21B 44/04 |
| 2019/0048707 | A1 * | 2/2019 | Benson | E21B 7/068 |
| 2019/0218901 | A1 | 7/2019 | Groover et al. | |
| 2020/0063546 | A1 * | 2/2020 | Weideman | E21B 7/061 |
| 2020/0165913 | A1 * | 5/2020 | Benson | E21B 7/068 |
| 2021/0025269 | A1 | 1/2021 | Zaripov | |

FOREIGN PATENT DOCUMENTS

| | | | |
|---|---|---|---|
| CA | 2582365 | A1 | 4/2006 |
| CA | 2636249 | A1 | 8/2007 |
| CA | 2700258 | A1 | 3/2009 |
| CA | 2921163 | A1 | 4/2015 |
| CA | 2938521 | A1 | 9/2015 |

OTHER PUBLICATIONS

"Practical Directional Drilling Techniques in Pinedale Field Wyoming to Improve Drilling Performance", Guangzhi Han, et al., SPE 167141, Society of Petroleum Engineers, 2013.

* cited by examiner

METHODS, SYSTEMS, AND MEDIA FOR CONTROLLING A TOOLFACE OF A DOWNHOLE TOOL

CROSS REFERENCE TO RELATED APPLICATION(S)

This application is related to and claims priority to Canadian Patent Application No.: 3095505 filed on Oct. 6, 2020, the contents of which are incorporated by reference herein

TECHNICAL FIELD

The present disclosure relates to methods, systems, and computer-readable media for controlling a toolface of a downhole tool.

BACKGROUND TO THE DISCLOSURE

During oil and gas drilling, a drill bit located at the end of a drill string is rotated into and through a formation to drill a wellbore. One form of drilling is directional drilling, in which the drill string has a slight bend near its distal end. During directional drilling, it is common practice to alternate between sliding and rotating. When sliding, the drill string is rotated to a particular orientation, and then drilling proceeds with the drill string maintained in this constant orientation, allowing the driller to alter the direction of the wellbore via the bend in the drill string. When rotating, the entire drill string is rotated, allowing the driller to drill forward in a straight line from the last slide. The driller alternates between rotating and sliding, to steer the wellbore as desired.

During the sliding portions of the drilling operation, the driller needs to ensure that the toolface (e.g. the orientation) of a mud motor/bent sub connected to the downhole tool is properly set, to point, using the bend in the mud motor, the drill bit in the desired direction. However, a reactive torque is produced by the mud motor that may cause the toolface to rotate to the left, and for which the driller must account. If the reactive torque is not properly accounted for, then the driller may be required to lift off bottom, shut off automated toolface control and make quill and/or autodriller adjustments, or else allow automatic toolface control to make quill and/or autodriller adjustments. All of these options, however, will result in less optimal results, i.e. the drilling taking more time and/or the drilling proceeding at a suboptimal toolface.

SUMMARY OF THE DISCLOSURE

There is described a method of determining a reactive torque factor for use in controlling a toolface of a downhole tool, comprising: for each of one or more sliding operations, using one or more processors to: (i) determine a change in a top drive position of a drive unit operable to rotate a drill string connected to the downhole tool; (ii) determine a change in a toolface of the downhole tool; (iii) determine a change in a differential pressure; and (iv) determine a reactive torque factor estimate based on the change in the top drive position, the change in the toolface, and the change in the differential pressure.

The method may further comprise obtaining, from one or more drilling parameter sensors, one or more readings of the top drive position, the toolface, and the differential pressure, wherein (i)-(iv) are performed by the one or more processors receiving and processing the one or more readings.

The one or more sliding operations may comprise one or more previous sliding operations, and the method may further comprise, during a current sliding operation subsequent to the one or more previous sliding operations, adjusting one or more drilling parameter setpoints based on the one or more reactive torque factor estimates determined for the one or more previous sliding operations.

The one or more drilling parameter setpoints may comprise one or more of a top drive position setpoint and a differential pressure setpoint.

Adjusting the one or more drilling parameter setpoints based on the one or more reactive torque factor estimates may comprise adjusting the one or more drilling parameter setpoints in order to rotate the drill string based on the one or more reactive torque factor estimates.

Determining the reactive torque factor estimate may comprise determining:

$$\frac{\Delta TopDrive - \Delta Toolface}{\Delta DiffP},$$

wherein ΔTopDrive is the change in the top drive position, ΔToolface is the change in the toolface, and ΔDiffP is the change in the differential pressure.

The change in the top drive position may be determined based on the top drive position at a start of the sliding operation. The change in the toolface may be determined based on the toolface at the start of the sliding operation. The change in the differential pressure may be determined based on the differential pressure at the start of the sliding operation.

Determining the change in the toolface may comprise: determining a steady state position of the toolface; determining whether a magnitude of the change in the toolface is greater than a preset threshold; and based on whether the magnitude of the change in the toolface is greater than the preset threshold, determining whether the toolface has changed in a direction toward or away from the steady state position of the toolface.

For each of the one or more sliding operations: (i)-(iv) may be performed multiple times to thereby obtain multiple reactive torque factor estimates; and the method may further comprise determining an average reactive torque factor based on the multiple reactive torque factor estimates.

The method may further comprise, for at least one of the one or more sliding operations, determining whether to discard the average reactive torque factor based on a difference between the average reactive torque factor determined for the at least one sliding operation and one or more average reactive torque factors determined for one or more sliding operations prior to the at least one sliding operation.

Determining the average reactive torque factor may comprise: filtering the multiple reactive torque factor estimates based on whether or not: one or more of the determined changes in the toolface are indicative of the toolface being at a steady state; or one or more of the determined changes in the differential pressure are indicative of the differential pressure being at a steady state.

The method may further comprise determining one or more of: one or more differences between a toolface setpoint and one or more toolface readings, wherein the toolface is determined to be at the steady state based on the one or more differences between the toolface setpoint and the one or more toolface readings; and one or more differences between a differential pressure setpoint and one or more differential pressure readings, wherein the differential pressure is determined to be at the steady state based on the one or more differences between the differential pressure setpoint and the one or more differential pressure readings.

The method may further comprise determining a relationship between the reactive torque factor and a depth of a wellbore through which the downhole tool is drilling, based on the reactive torque factor estimate determined for each sliding operation and based on a depth associated with each sliding operation.

Determining the relationship between the reactive torque factor and the depth of the wellbore may comprise: inputting each reactive torque factor estimate to a Kalman filter; and determining, using the Kalman filter, the relationship between the reactive torque factor and the depth of the wellbore.

The method may further comprise, before determining the relationship between the reactive torque factor and the depth of the wellbore: for each sliding operation, determining a measurement variance by performing one or more of: determining a variance of the reactive torque factor estimate over the sliding operation; and determining an efficiency metric indicative of a variance of one or more toolface readings obtained over the sliding operation; and inputting each determined measurement variance to the Kalman filter.

The one or more sliding operations may comprise one or more previous sliding operations, and the method may further comprise, during a current sliding operation subsequent to the one or more previous sliding operations: using the determined relationship to determine a reactive torque factor based on a depth associated with the current sliding operation; and adjusting one or more drilling parameter setpoints based on the determined reactive torque factor.

The one or more drilling parameter setpoints may comprise one or more of a top drive position setpoint and a differential pressure setpoint.

Adjusting the one or more drilling parameter setpoints based on the determined reactive torque factor may comprise adjusting the one or more drilling parameter setpoints in order to rotate the drill string based on the determined reactive torque factor.

(i)-(iv) may performed during the sliding operation.

(i)-(iv) may be performed after the sliding operation.

According to a further aspect of the disclosure, there is provided a computer-readable medium having stored thereon computer program code configured, when executed by one or more processors, to cause the one or more processors to perform a method of determining a reactive torque factor for use in controlling a toolface of a downhole tool, wherein the method comprises: for each of one or more sliding operations: (i) determining a change in a top drive position of a drive unit operable to rotate a drill string connected to the downhole tool; (ii) determining a change in a toolface of the downhole tool; (iii) determining a change in a differential pressure; and (iv) determining a reactive torque factor estimate based on the change in the top drive position, the change in the toolface, and the change in the differential pressure.

According to a further aspect of the disclosure, there is provided a system comprising: a drill string comprising a downhole tool at a downhole end thereof; a drive unit operable to rotate the drill string; and a toolface controller for controlling a toolface of the downhole tool, the toolface controller comprising computer-readable memory and one or more processors, wherein the compute-readable memory comprises computer program code configured, when executed by the one or more processors, to cause the one or more processors to perform a method of determining a reactive torque factor for use in controlling the toolface of the downhole tool, and wherein the method comprises: for each of one or more sliding operations: (i) determining a change in a top drive position of a drive unit operable to rotate a drill string connected to the downhole tool; (ii) determining a change in a toolface of the downhole tool; (iii) determining a change in a differential pressure; and (iv) determining a reactive torque factor estimate based on the change in the top drive position, the change in the toolface, and the change in the differential pressure.

According to a further aspect of the disclosure, there is provided a system comprising: a drill string comprising a downhole tool at a downhole end thereof; a drive unit operable to rotate the drill string; and a toolface controller for controlling a toolface of the downhole tool, the toolface controller comprising computer-readable memory and one or more processors, wherein the compute-readable memory comprises computer program code configured, when executed by the one or more processors, to cause the one or more processors to perform a method of determining a reactive torque factor for use in controlling the toolface of the downhole tool, and wherein the method comprises: for each of one or more sliding operations: (i) determining a change in a top drive position of the drive unit; (ii) determining a change in the toolface; (iii) determining a change in a differential pressure; and (iv) determining a reactive torque factor estimate based on the change in the top drive position, the change in the toolface, and the change in the differential pressure; determining a relationship between the reactive torque factor and a depth of a wellbore by: inputting to a Kalman filter each reactive torque factor estimate and a depth associated with each of the one or more sliding operations; and determining, using the Kalman filter, the relationship between the reactive torque factor and the depth of the wellbore; and during a current sliding operation subsequent to the one or more sliding operations, using the determined relationship to determine a reactive torque factor based on a depth associated with the current sliding operation; and adjusting one or more drilling parameter setpoints based on the determined reactive torque factor.

BRIEF DESCRIPTION OF THE DRAWINGS

In the accompanying drawings, which illustrate one or more example embodiments.

DETAILED DESCRIPTION

The present disclosure seeks to provide improved methods, systems, and computer-readable media for controlling a toolface of a downhole tool. While various embodiments of the disclosure are described below, the disclosure is not limited to these embodiments, and variations of these embodiments may well fall within the scope of the disclosure which is to be limited only by the appended claims.

Generally, there are described methods, systems, and computer-readable media for providing improved control of a toolface of a downhole tool over multiple sliding operations (or "slides") of an overall drilling operation. In particular, embodiments of the disclosure are directed at automatically calculating and updating a reactive torque factor, and using the reactive torque factor to assist in controlling the toolface of the downhole tool.

For example, over a given slide, a toolface controller may monitor changes in top drive position, toolface, and differential pressure. Based on the changes in top drive position, toolface, and differential pressure, the toolface controller may determine a reactive torque factor estimate for the slide. The process may be repeated for each of one or more subsequent slides in the drilling operation. The multiple reactive torque estimates that are obtained may be processed, for example by using a Kalman filter, to determine a relationship between the reactive torque factor and a depth of the wellbore through which the drilling operation is proceeding.

While off bottom, shortly before the start of a subsequent slide, the relationship may be used to determine a reactive torque factor that is to be used for controlling the toolface during the subsequent slide, based on a current depth of the wellbore. For example, the drill string connected to the downhole tool may be rotated by an amount that is based on the reactive torque factor determined to be used for the slide.

Figure 1:
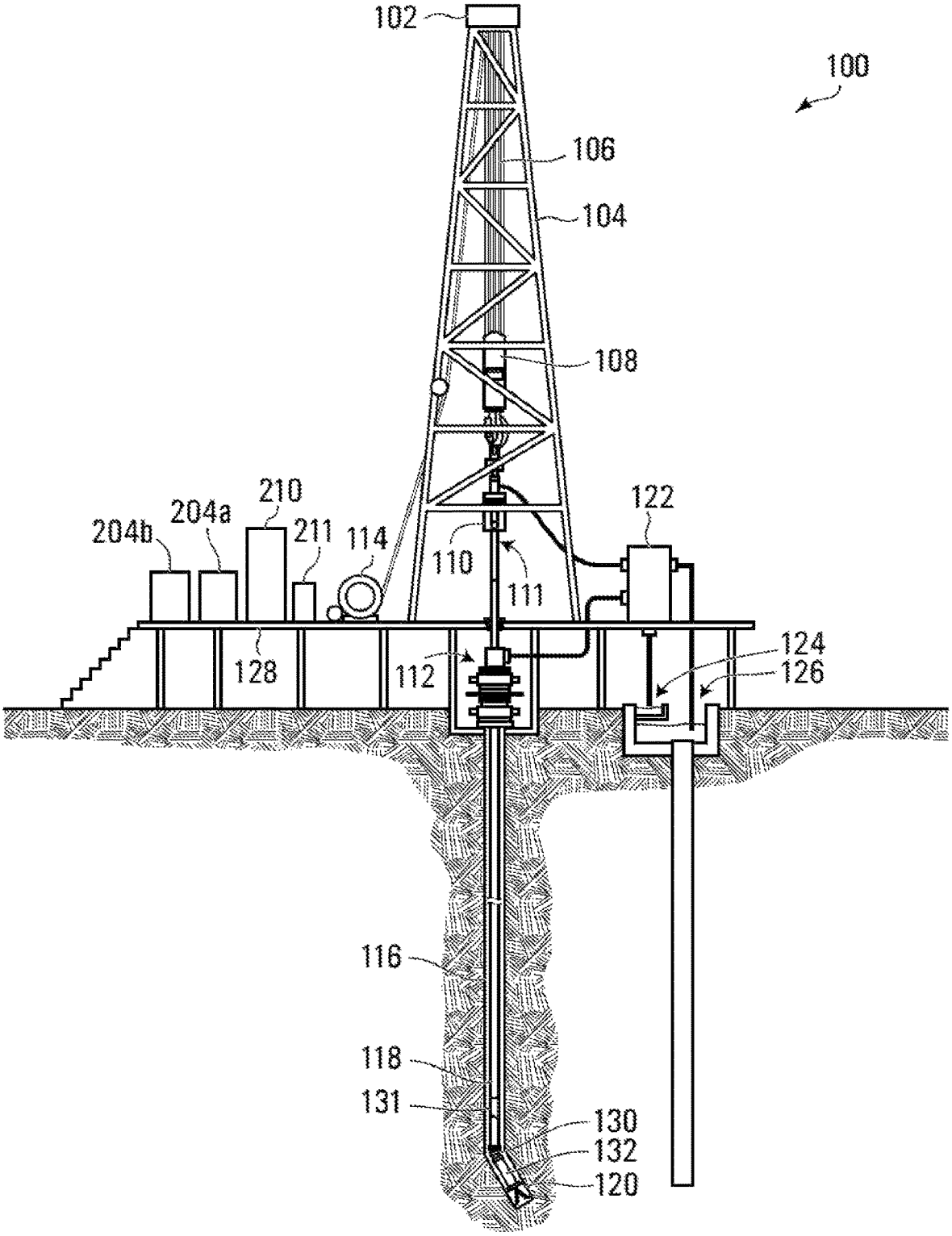
FIG. 1 is a schematic of a drilling rig, according to embodiments of the disclosure.

FIG. 1 shows a drilling rig 100, according to one embodiment. The rig 100 comprises a derrick 104 that supports a drill string 118. The drill string 118 has a drill bit 120 at its downhole end, which is used to drill a wellbore 116. A drawworks 114 is located on the drilling rig's 100 floor 128. A drill line 106 extends from the drawworks 114 to a traveling block 108 via a crown block 102. The traveling block 108 is connected to the drill string 118 via a top drive 110. The top drive 110 is connected to the drill string 118 by a tubular section known as a quill 111. Rotating the drawworks 114 consequently is able to change weight-on-bit (WOB) during drilling, with rotation in one direction lifting the traveling block 108 and generally reducing WOB and rotation in the opposite direction lowering the traveling block 108 and generally increasing WOB. The drill string 118 also comprises, near the drill bit 120, a bent sub 130 and a mud motor 132. The mud motor's 132 rotation is powered by the flow of drilling mud through the drill string 118, as discussed in further detail below, and combined with the bent sub 130 permits the rig 100 to perform directional drilling. The top drive 110 and mud motor 132 collectively provide rotational force to the drill bit 120 that is used to rotate the drill bit 120 and drill the wellbore 116. While in FIG. 1 the top drive 110 is shown as an example rotational drive unit, in a different embodiment (not depicted) another rotational drive unit may be used, such as a rotary table.

A mud pump 122 rests on the floor 128 and is fluidly coupled to a shale shaker 124 and to a mud tank 126. The mud pump 122 pumps mud from the tank 126 into the drill string 118 at or near the top drive 110, and mud that has circulated through the drill string 118 and the wellbore 116 return to the surface via a blowout preventer ("BOP") 112. The returned mud is routed to the shale shaker 124 for filtering and is subsequently returned to the tank 126.

Uphole of the bent sub 130 is located a measurement-while-drilling (MWD) tool 131. MWD tool 131 collects and transmits data from inside the wellbore 116, such as formation properties, rotational speed, vibration, temperature, torque, pressure, and mud flow. The MWD tool 131 measures the inclination, azimuth, and toolface orientation of a downhole tool near the drill bit 120. Toolface orientation (or simply "toolface") combined with inclination, azimuth, and the geometry of the bottom hole assembly can be used to determine the trajectory of the drill string 118.

The MWD data may be transferred to the surface using any of various means, such as mud pulse telemetry, electromagnetic telemetry (generally for relatively shallow depths), acoustic telemetry, or a wired drill pipe. The MWD data is decoded at the surface by an MWD decoder 211. Generally, the decoded MWD data is sent to a directional driller's workstation and doghouse computer (see below).

Figure 2:
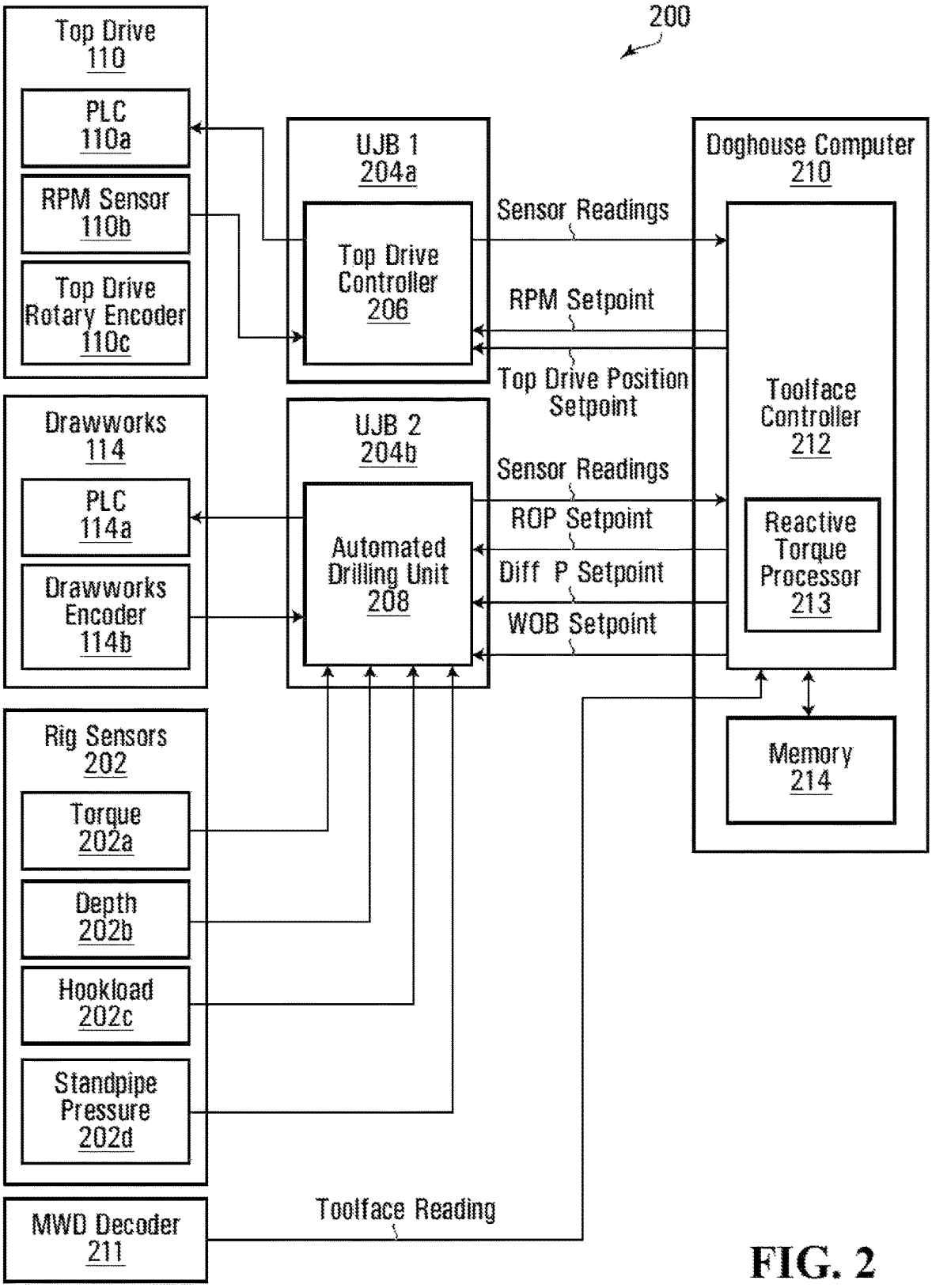
FIG. 2 is a block diagram of a system for performing automated drilling of a wellbore, according to embodiments of the disclosure.

FIG. 2 shows a block diagram of a system 200 for performing automated drilling of a wellbore, according to the embodiment of FIG. 1. The system 200 comprises various rig sensors: a torque sensor 202*a*, depth sensor 202*b*, hookload sensor 202*c*, and standpipe pressure sensor 202*d* (collectively, "sensors 202").

The system 200 also comprises the drawworks 114 and top drive 110. The drawworks 114 comprises a programmable logic controller ("drawworks PLC") 114*a* that controls the drawworks' 114 rotation and a drawworks encoder 114*b* that outputs a value corresponding to the current height of the traveling block 108. The top drive 110 comprises a top drive programmable logic controller ("top drive PLC") 110*a* that controls the top drive's 114 rotation and a revolutions-per-minute (RPM) sensor 110*b* that outputs the rotational rate of the drill string 118. More generally, the top drive PLC 110*a* is an example of a rotational drive unit controller and the RPM sensor 110*b* is an example of a rotation rate sensor. In addition, top drive 110 further includes a top drive rotary encoder 110*c* (mounted within or externally to the top drive 110). Top drive rotary encoder 110*c* is used to measure the angle of rotation of quill 111. Top drive rotary encoder 110*c* is an example of a rotational position sensor and is used to provide a feedback signal for controlling the toolface of the downhole tool, as described in further detail below.

A first junction box 204*a* houses a top drive controller 206, which is communicatively coupled to the top drive PLC 110*a*, the RPM sensor 110*b*, and the top drive rotary encoder 110*c*. The top drive controller 206 controls the rotation rate and rotational position of the drill string 118 by instructing the top drive PLC 110*a* and obtains the rotational position, rate of rotation, and direction of rotation of the drill string 118 from top drive rotary encoder 110*c*.

A second junction box 204*b* houses an automated drilling unit 208 (or simply "automatic driller 208"), which is communicatively coupled to the drawworks PLC 114*a* and the drawworks encoder 114*b*. The automated drilling unit 208 modulates WOB during drilling by instructing the drawworks PLC 114*a* and obtains the height of the traveling block 108 from the drawworks encoder 114*b*. In different embodiments, the height of the traveling block 108 can be obtained digitally from rig instrumentation, such as directly from the PLC 114*a* in digital form. In different embodiments (not depicted), the junction boxes 204*a*, 204*b* may be combined in a single junction box, comprise part of the doghouse computer 210, or be connected indirectly to the doghouse computer 210 by an additional desktop or laptop computer.

The automated drilling unit 208 is also communicatively coupled to each of the sensors 202. In particular, the automated drilling unit 208 determines WOB from the hookload sensor 202*c* and determines the rate of penetration (ROP) of the drill bit 120 by monitoring the height of the traveling block 108 over time.

Figure 6:
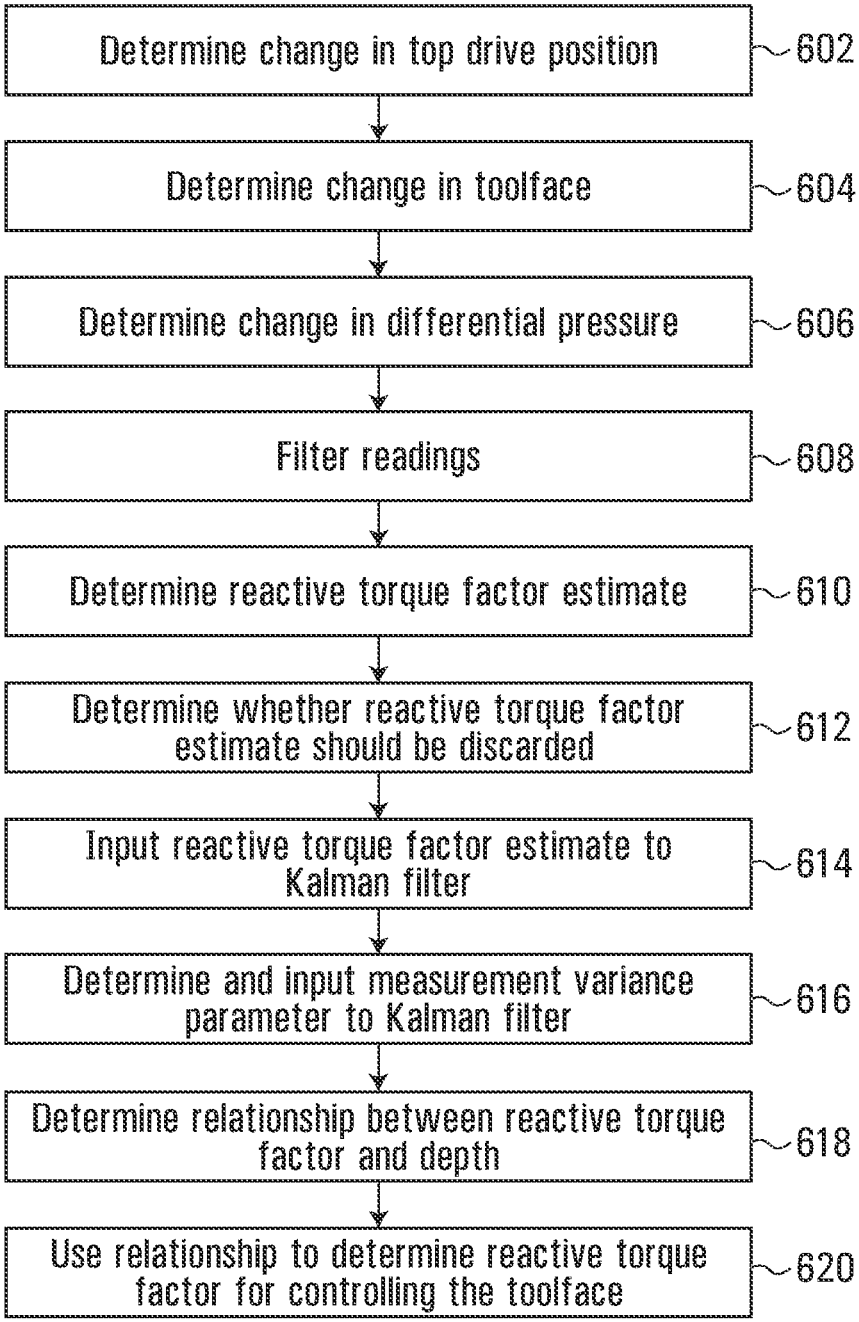
FIG. 6 depicts a flow diagram of a method of calculating a reactive torque factor for controlling a toolface of a downhole tool, according to embodiments of the disclosure.

The system 200 also comprises a doghouse computer 210. The doghouse computer 210 comprises a toolface controller 212 and memory 214 communicatively coupled to each other. The memory 214 stores on it computer program code that is executable by the toolface controller 212 and that, when executed, causes the toolface controller 212 to perform methods for performing automated drilling of the wellbore 116. Toolface controller 212 includes a reactive torque processor 213 for calculating and updating a reactive torque factor during the drilling operation, for example as shown by the method of FIG. 6, described in further detail below. The reactive torque factor determined by reactive torque processor 213 is used by toolface controller 212 to perform methods for controlling a toolface of the downhole tool. The toolface controller 212 receives readings from the RPM sensor 110*b*, drawworks encoder 114*b*, top drive rotary encoder 110*c*, and the rig sensors 202. MWD decoder 211, having received a toolface reading from downhole MWD tool 131, transmits the toolface reading directly to toolface controller 212.

The toolface controller 212 sends one or more of an ROP setpoint, a differential pressure setpoint, and a WOB setpoint to the automated drilling unit 208, and one or more of an RPM setpoint and a top drive position setpoint to the top drive controller 206. The top drive position setpoint may include a rotational position setpoint of the top drive 110 (indicative of a desired rotational position of the top drive 110), or a rotational position setpoint indicative of a target midpoint about which the top drive 110 is oscillated (or a target neutral point in the case of asymmetric oscillations). The top drive controller 206 and automated drilling unit 208 relay these setpoints to the top drive PLC 110*a* and drawworks PLC 114*a*, respectively, where they are used for automated drilling.

Each of the first and second junction boxes may comprise a Pason Universal Junction Box™ (UJB) manufactured by Pason Systems Corp. of Calgary, Alberta. The automated drilling unit 208 may be a Pason Autodriller™ manufactured by Pason Systems Corp. of Calgary, Alberta.

The top drive controller 206, automated drilling unit 208, and doghouse computer 210 are respective example types of drilling controllers. In the system 200 of FIG. 2, the top drive controller 206 and the automated drilling unit 208 are distinct and respectively use the RPM and top drive position setpoints, and the WOB, differential pressure, and ROP setpoints, for automated drilling. However, in different embodiments (not depicted), the functionality of the top drive controller 206 and automated drilling unit 208 may be combined or may be divided between three or more controllers. In certain embodiments (not depicted), the toolface controller 212 may directly communicate with any one or more of the top drive 110, drawworks 114, sensors 202, and MWD decoder 211. Additionally or alternatively, in different embodiments (not depicted) automated drilling may be done in response to only the RPM setpoint, only the ROP setpoint, only the WOB setpoint, only the differential pressure setpoint, only the top drive position setpoint, or any combination thereof, possibly in combination with one or more other drilling parameters. Examples of these additional drilling parameters comprise, for example, depth of cut, torque, and flow rate (into the wellbore 116, out of the wellbore 116, or both).

In the depicted embodiments, the top drive controller 206 and the automated drilling unit 208 acquire data from the sensors 202 discretely in time at a sampling frequency F_s, and this is also the rate at which the doghouse computer 210 acquires the sampled data. Accordingly, for a given period T, N samples are acquired with N=TF_s. In different embodiments (not depicted), the doghouse computer 210 may receive the data at a different rate than that at which it is sampled from the sensors 202. Additionally or alternatively, the top drive controller 206 and the automated drilling unit 208 may sample data at different rates, and more generally in embodiments in which different equipment is used data may be sampled from different sensors 202 at different rates.

Figure 3:
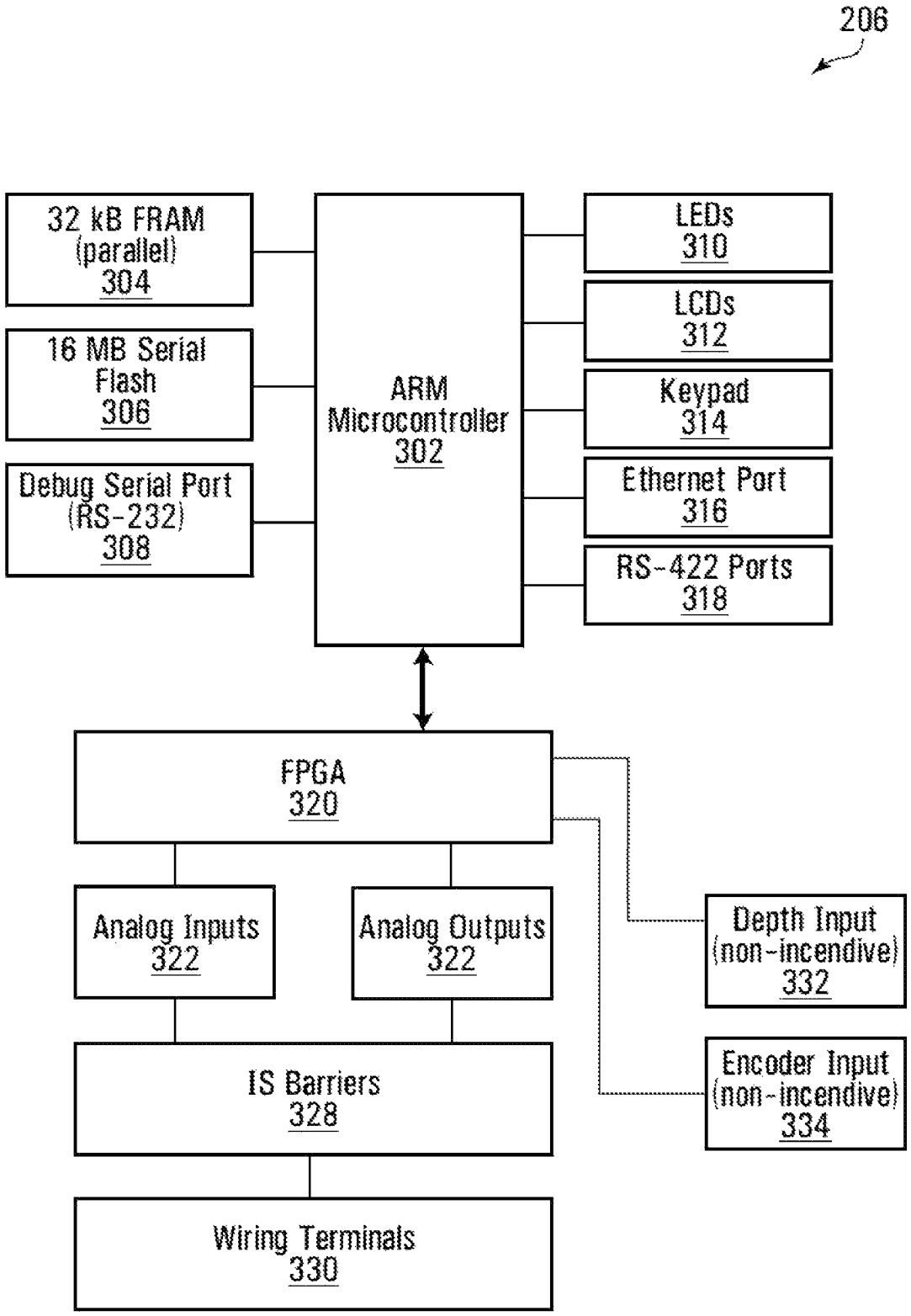
FIG. 3 depicts a block diagram of the automatic driller of FIG. 1.

Referring now to FIG. 3, there is shown a hardware block diagram 300 of the second junction box 204*b* of FIG. 2. The second junction box 204*b* comprises a microcontroller 302 communicatively coupled to a field programmable gate array ("FPGA") 320. The depicted microcontroller 302 is an ARM-based microcontroller, although in different embodiments (not depicted) the microcontroller 302 may use a different architecture. The microcontroller 302 is communicatively coupled to 32 kB of non-volatile random access memory ("RAM") in the form of ferroelectric RAM 304; 16 MB of flash memory 306; a serial port 308 used for debugging purposes; LEDs 310, LCDs 312, and a keypad 314 to permit a driller to interface with the automatic driller 208; and communication ports in the form of an Ethernet port 316 and RS-422 ports 318. While FIG. 3 shows the microcontroller 302 in combination with the FPGA 320, in different embodiments (not depicted) different hardware may be used. For example, the microcontroller 302 may be used to perform the functionality of both the FPGA 320 and microcontroller 302 in FIG. 3; alternatively, a PLC may be used in place of one or both of the microcontroller 302 and the FPGA 320.

The microcontroller 302 communicates with the hookload and standpipe pressure sensors 202*c*,202*d* via the FPGA 320. More specifically, the FPGA 320 receives signals from these sensors 202*c*,202*d* as analog inputs 322; the FPGA 320 is also able to send analog signals using analog outputs 324. These inputs 322 and outputs 324 are routed through intrinsic safety ("IS") barriers for safety purposes, and through wiring terminals 330. The microcontroller 302 communicates using the RS-422 ports 318 to the PLC 114*a*; accordingly, the microcontroller 302 receives signals from a block height sensor (not shown) and the torque sensor 202*a* and sends signals to a variable frequency drive (or, in some embodiments, a braking device) via the RS-422 ports 318. According to some embodiments, automatic driller 208 outputs a throttle signal to a PLC using an analog output.

According to some embodiments, automatic driller 208 communicates with a band brake controller using an RS-422 port.

The FPGA 320 is also communicatively coupled to a non-incendive depth input 332 and a non-incendive encoder input 334. In different embodiments (not depicted), the automatic driller 208 may receive different sensor readings in addition to or as an alternative to the readings obtained using the depicted sensors 202*a*,202*b*,202*c*,202*d*.

First junction box 204*a*, comprising top drive controller 206, comprises an input/output architecture similar to that of second junction box 204*b* shown in FIG. 3. However, the RS-422 port is not used, and all an inputs/outputs use analog or discrete digital signaling.

Figure 4:
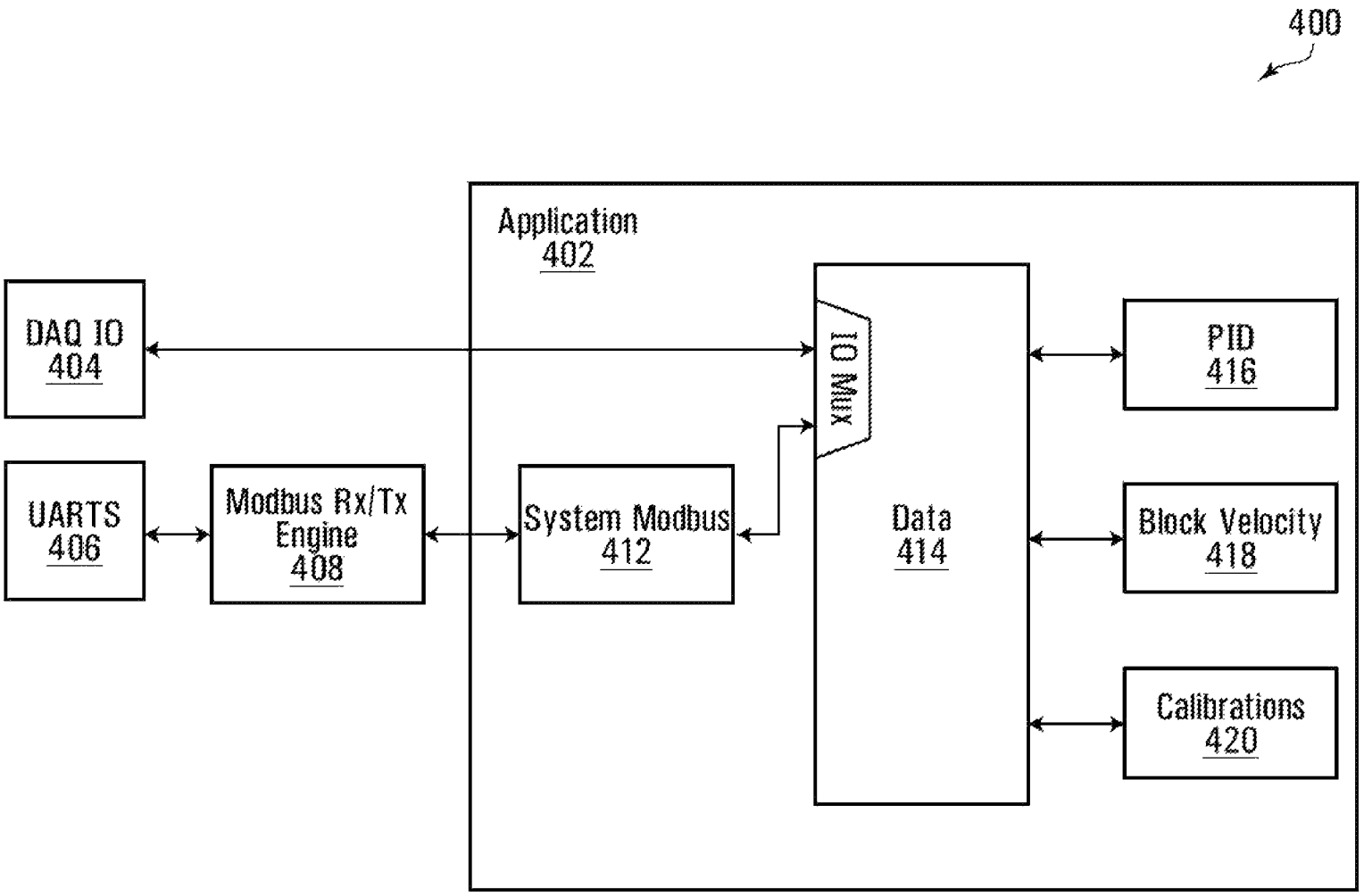
FIG. 4 depicts a block diagram of software modules running on the automatic driller of FIG. 1.

Referring now to FIG. 4, there is shown a block diagram of software modules, some of which comprise a software application 402, running on the automatic driller of FIG. 3. The application 402 comprises a data module 414 that is communicative with a PID module 416, a block velocity module 418, and a calibrations module 420. The microcontroller 302 runs multiple PID control loops in order to determine the signal to send to the PLC 114*a* to control the variable frequency drive; the microcontroller 302 does this in the PID module 416. The microcontroller 302 uses the block velocity module 418 to determine the velocity of the traveling block 108 from the traveling block height derived using measurements from the block height sensor. The microcontroller 302 uses the calibrations module 420 to convert the electrical signals received from the sensors 202*a*,202*b*,202*c*,202*d* into engineering units; for example, to convert a current signal from mA into kilopounds.

The data module 414 also communicates using an input/output multiplexer, labeled "IO Mux" in FIG. 4. In one of the multiplexer states the data module 414 communicates digitally via the Modbus protocol using the system modbus 412 module, which is communicative with a Modbus receive/transmit engine 408 and the UARTS 406. In another of the multiplexer states, the data module 414 communicates analog data directly using the data acquisition in/out module 404. While in FIG. 4 the Modbus protocol is shown as being used, in different embodiments (not depicted) a different protocol may be used, such as another suitable industrial bus communication protocol.

Figure 5:
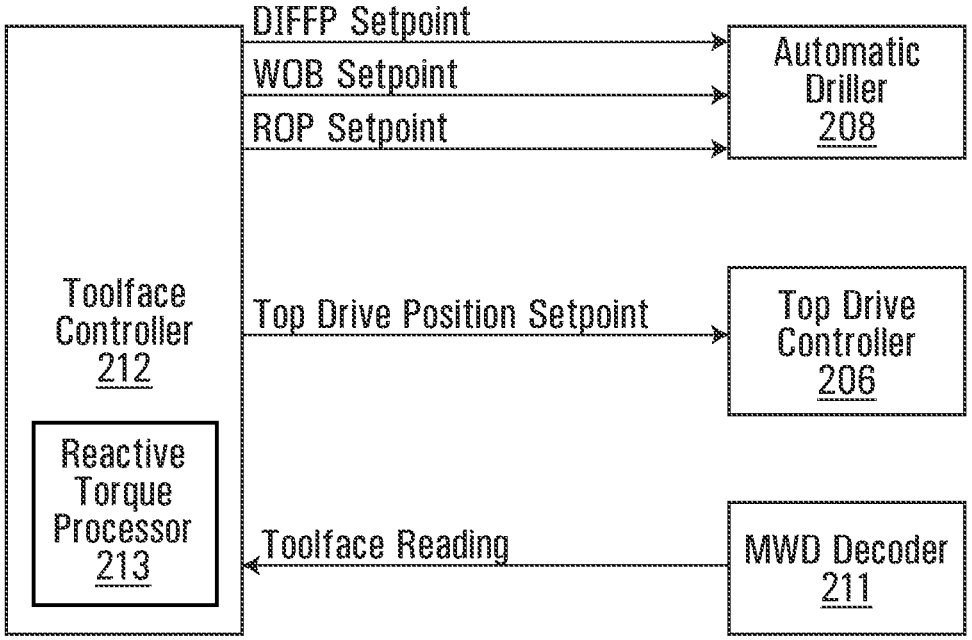
FIG. 5 depicts a block diagram of a toolface controller interacting with the automatic driller and top drive controller of FIG. 2, according to embodiments of the disclosure.

Turning to FIG. 5, there is shown a block diagram of toolface controller 212 interacting with automatic driller 208, top drive controller 206, and MWD decoder 211. As described in further detail below, toolface controller 212 determines, depending on the desired toolface correction, adjustments to one or more drilling parameter setpoints, and inputs the adjusted drilling parameter setpoint(s) to automatic driller 208 and/or top drive controller 206 to correct the toolface of the downhole tool, e.g. by minimizing a difference between a measured toolface and the toolface setpoint (e.g. a desired toolface).

As described above, top drive controller 206 manages the rotation of drill string 118, controls the oscillation of drill string 118, and effects changes to the rotational position of top drive 110. When performing rotational drilling, top drive controller 206 rotates drill string 118 constantly in the same direction (e.g. to the right). When sliding, in order to maintain toolface control, top drive controller 206 provides changes to one or more of a rotational position of the top drive 110 and a midpoint (or neutral point) about which the top drive 110 is oscillated. Generally, when sliding in the lateral, top drive controller 206 oscillates the top of drill string 118 a set amount in each direction. This reduces friction along drill string 118 and allows for smoother sliding. The amount of oscillation is chosen to allow most of drill string 118 to have some rotation without this rotation reaching the downhole tool. Changes to the midpoint or neutral point of this oscillation will propagate to the toolface over time. While oscillation can be used during vertical drilling and in the build, it is generally more often used while drilling in the lateral.

MWD decoder 211 receives from MWD tool 131 encoded data relating the toolface of the downhole tool (e.g. every 30 seconds, for example). MWD decoder 211 may decode the data to determine the current toolface and provides the toolface reading to toolface controller 212. MWD decoding can be performed through a variety of means, depending on how the data is sent. If the data is transmitted using mud-pulse telemetry, then MWD decoder 211 uses pressure information from a pressure sensor, such as standpipe pressure sensor 202*d*, to identify signals sent through the mud. MWD decoder 211 decodes the data and sends the toolface reading to toolface controller 212. The frequency of the updates to the current toolface may depend on equipment, conditions, and depth. When a toolface reading is received from MWD decoder 211, toolface controller 212 determines the magnitude of the required correction and determines whether to correct using automatic driller 208, top drive controller 206, or a combination of both. Generally, for small corrections, top drive controller 206 is used if the correction requires a right turn while automatic driller 208 if the correction requires a left turn. If the required correction is large, both top drive controller 206 and automatic driller 208 may be used. Large corrections and small corrections may be defined by the user. For example, according to some embodiments, a large correction may be a correction greater than 90 degrees, and, according to some embodiments, a small correction may be a correction between about 5 degrees and 90 degrees. Toolface controller 212 may use a proportional-integral-derivative (PID) controller for controlling the toolface.

During drilling, a reactive torque is produced by the mud motor 132 that may cause the toolface to rotate to the left. Differential pressure may be used as a proxy for reactive torque. Differential pressure is roughly the difference between on- and off-bottom standpipe pressure which may be a proxy for the pressure loss across the mud motor 132. In practice, it is easier to increase differential pressure than to decrease differential pressure. In general, it may be preferable to increase differential pressure so as to allow drilling rig 100 to drill faster. Increasing differential pressure may generally translate into increasing WOB, resulting in a higher reactive torque. If a leftward toolface correction is required, differential pressure may be increased to produce a left turn and increased ROP. Using differential pressure for rightward toolface corrections may require reducing differential pressure, accomplished through drilling off WOB, and may translate into slower drilling. Therefore, rightward toolface corrections may be better accomplished through changes to the rotational position of the top drive 110.

According to embodiments of the disclosure, there will now be described a method of determining a reactive torque factor for use in controlling a toolface of a downhole tool. The reactive torque factor, which may also be referred to as "ReactiveT_Factor", defines a relationship between differential pressure and pipe twist (e.g. 90 degrees per 1,000 kPa), and is an approximation of the spring constant of drill string 118. Thus, ReactiveT_Factor reflects, for a given differential pressure, the amount top drive 110 should be rotated in order to maintain a stable toolface.

According to embodiments of the disclosure, the determination of ReactiveT_Factor may be automated and performed on a per-slide basis. By calculating a reactive torque factor estimate for each slide, a relationship between reactive torque factor and depth of the wellbore may be established. At the beginning of each new slide, the relationship may be used to estimate the value of ReactiveT_Factor that is to be used when calculating one or more setpoints for controlling the toolface. By improving the accuracy of the determination of ReactiveT_Factor, the drilling process can be made more accurate. Conversely, if ReactiveT_Factor is inaccurately calculated, then the driller may be required to lift off bottom, shut off automated toolface control and make quill and/or autodriller adjustments, or else allow automatic toolface control to make quill and/or autodriller adjustments. All of these options, however, will result in less optimal results, i.e. the drilling taking more time and/or the drilling proceeding at a suboptimal toolface.

Turning to FIG. 6, there is shown an example method of determining ReactiveT_Factor as a function of depth during a drilling operation. As mentioned above, ReactiveT_Factor is estimated for each slide in a sequence of slides.

At block 602, reactive torque processor 213 determines a change in a position of top drive 110 ("top drive position") since the beginning of the current slide. The change in the top drive position, ΔTopDrive, may be determined, for example, from readings from top drive rotary encoder 110*c*. At block 604, reactive torque processor 213 determines a change in a toolface of the downhole tool since the beginning of the current slide. The change in the toolface, ΔToolface, may be determined, for example, from readings from MWD Decoder 211. At block 606, reactive torque processor 213 determines a change in a differential pressure since the beginning of the current slide. The change in the differential pressure, ΔDiffP, may be determined, for example, from readings from standpipe pressure sensor 202*d*.

The order in which the operations of blocks 602, 604, and 606 are performed is not fixed, and the operations may be performed, for example, in a different order, or substantially simultaneously.

At block 608, reactive torque processor 213 may discard one or more readings obtained at block 602, 604, and 606 according to one or more preset and user-configurable rules. For example, reactive torque processor 213 may ignore any differential pressure reading that results in a ΔDiffP value of less than a preset threshold, such as 300 kPa, as well as any differential pressure reading that results in a negative ΔDiffP value.

At block 610, reactive torque processor 213 determines a reactive torque factor estimate according to $$\frac{\Delta TopDrive - \Delta Toolface}{\Delta DiffP},$$

wherein ΔTopDrive is the change in the top drive position, ΔToolface is the change in the toolface, and ΔDiffP is the change in the differential pressure. The reactive torque factor estimate is calculated every second and averaged over the length of the slide.

When determining the change in the toolface of the downhole tool, reactive torque processor 213 may detect the direction in which the toolface has changed. For example, a reading corresponding to a change in toolface of 90 degrees to the right may be indistinguishable from a reading corresponding to a change in toolface of 270 degrees to the left. In order to determine the direction in which the toolface has changed, reactive torque processor 213 may first determine an estimated steady state position of the toolface according to initToolface−(ΔDiffP*ReactiveT_Factor)+ΔTopDrive, wherein initToolface is the toolface at the start of the slide, and ReactiveT_Factor is the last known reactive torque factor. When ΔToolface is determined to be greater than a predetermined threshold, reactive torque processor 213 assumes that the toolface has moved towards the estimated steady state toolface position.

Furthermore, when calculating the reactive torque factor estimate, reactive torque processor 213 may be configured to prioritize one or more sequences of data points in which differential pressure and toolface are stable at their respective setpoints. For instance, if the toolface is determined to be at or close to the toolface setpoint for a predetermined number of consecutive data points, and if differential pressure is determined to be at or close to the differential pressure setpoint for a predetermined number of consecutive data points, then reactive torque processor 213 may be configured to only use these values obtained for the toolface and the differential pressure when calculating ΔToolface and ΔDiffP, while discarding other toolface and differential pressure readings obtained during the slide. Readings indicative of the toolface and the differential pressure being at or close to their respective setpoints may indicate that the toolface is approximately at steady state, in which case it is likely that a reactive torque factor estimate based upon these specific readings will be more accurate.

Alternatively, if the differential pressure is determined to be at or close to the differential pressure setpoint for a predetermined number of consecutive data points, then reactive torque processor 213 may be configured to only use these values obtained for the differential pressure when calculating ΔDiffP, while discarding other differential pressure readings obtained during the slide.

Alternatively still, all data points obtained during the slide may be used in determining ΔTopDrive, ΔToolface, and ΔDiffP. Furthermore, reactive torque processor 213 may be configured to only consider values of ΔTopDrive, ΔToolface, and ΔDiffP once drill bit 120 is determined to be on bottom.

As described above, reactive torque processor 213 determines a reactive torque factor estimate for each slide in a sequence of consecutive slides. Once reactive torque processor 213 has determined multiple reactive torque factor estimates for multiple slides, the reactive torque factor estimates may be plotted to determine a relationship (in degrees/kPa/m) between the reactive torque factor and the depth of the wellbore through which the drilling operation is proceeding. Generally, the resulting relationship will be linear with some noise. Generally still, the reactive torque factor will increase as the depth of the wellbore increases. The reactive torque factor may be affected by such factors as wear on the mud motor, rock type, hole cleaning, etc.

At block 612, after having determined the reactive torque factor estimate for a given slide, reactive torque processor 213 may filter the reactive torque factor estimate by comparing the reactive torque factor estimate to one or more reactive torque factor estimates determined for one or more previous slides. For example, according to some embodiments, if the reactive torque factor estimate for the current slide is determined to be greater or less than, by at least two standard deviations, the median reactive torque factor estimate of the last six slides, then the reactive torque factor estimate for the current slide is determined to be an outlier and can be discarded. If on the other hand the reactive torque factor estimate for the current slide is not determined to be an outlier, then at block 614 reactive torque processor 213 inputs the reactive torque factor estimate to a Kalman filter. The Kalman filter is used to smooth the measurements obtained for the reactive torque factor estimates, and fit them into a model of the current well's reactive torque factor as a function of depth.

A Kalman filter may be more useful than, for example, a low-pass filter since the reactive torque factor increases with depth, and a low-pass filter for removing noise may introduce a delay when modelling the relationship between the reactive torque factor and depth. Furthermore, although the reactive torque factor vs. depth relationship is generally linear, as discussed above this relationship may change over time. Therefore, using a linear regression technique is likely to produce an inferior estimate of reactive torque factor vs. depth. In contrast, continually updating the Kalman filter with new reactive torque factor estimates calculated for new slides, while at the same time assuming the existence of some process noise, may account for such factors as motor wear, formation changes, equipment changes, and increased friction as the depth of the wellbore increases.

A Kalman filter is sometimes referred to as a linear quadratic estimator, and is a type of recursive Bayesian estimator. The goal of the Kalman filter is to estimate a state, s(n) (in this case the current reactive torque factor and how much the reactive torque factor changes with depth), based on a minimum mean square error estimate, applied at each update of the Kalman filter.

The relationship of reactive torque factor versus depth is modelled as a Gauss Markov process in which:

$$s(n)=As(n-1)+Bu(n);$$

$$z(n)=Hs(n)+w(n);$$

$$u(n)\sim N(0,Qu);$$

$$w(n)\sim N(0,Qw);\text{ and}$$

$$Z(n)=\{z(1),z(2),\ldots z(n-1),z(n)\},$$

and in which:
s(n) is the state at n;
u(n) is the innovation at n;
A is a state transition matrix;
B is an update mapping matrix;
Qu is an update covariance, or process covariance, matrix; and
Qw is a measurement covariance matrix.
The estimation of the state is performed in two phases: a prediction phase and an update phase.
Prediction
A priori state estimate:

$$s(n|n-1)=As(n-1|n-1)$$

A Priori Estimate Covariance:

$$M(n|n-1)=AM(n-1|n-1)AT+BQuBT$$

Update
Kalman Gain:

$$K(n)=M(n|n-1)H(n)T(H(n)M(n|n-1)H(n)T+Qw)-1$$

Correction (a Posteriori State Estimate):

$$S(n|n)=s(n|n-1)+K(n)(z(n)-H(n)s(n|n-1))$$

A Posteriori State Estimate Covariance:

$$M(n|n)=(I-K(n)H(n))M(n|n-1)$$

According to various embodiments, the specific parameters of the Kalman filter may be adjusted within the scope of the disclosure. For example, the specific Kalman filter that is used may be an extended Kalman filter in which the process is defined as non-linear and is linearized using a first-order Taylor approximation. The measurement covariance may be assumed to be constant. However, according to some embodiments, the measurement covariance may be assumed to be non-constant. At the start of the slide, only the prediction phase is executed, and the predicted value of ReactiveT_Factor is used for control during the slide. At the end of the slide, the update phase is executed to update the Kalman filter based on the reactive torque factor estimate determined for the slide.

Returning to FIG. 6, at block 616, reactive torque processor 213 determines a measurement variance parameter for the reactive torque factor estimate that is inputted to the Kalman filter. The order in which the operations of blocks 614 and 616 are performed is not fixed, and the operations may be performed, for example, in a different order, or substantially simultaneously. In order to determine the measurement variance parameter, reactive torque processor 213 determines the variance of the reactive torque factor estimate for the current slide, as well as the variance of one or more reactive torque factor estimates calculated for one or more previous slides. For example, according to some embodiments, reactive torque processor 213 determines the variance of the reactive torque factor estimates determined for the previous six slides. Based on the similarity between the variance of the current reactive torque factor estimate and the variance of the one or more previous reactive torque factor estimates, reactive torque processor 213 determines the measurement variance parameter that is input to the Kalman filter.

According to some embodiments, the measurement variance parameter may be determined according to the following:

$$\text{Measurement Variance Parameter}=(\text{Svariance}+\text{wrapVar})*\text{varFactor}/SEF,$$

in which:
SEF is Sliding Efficiency;
Svariance is the sample variance of the last six reactive torque factor estimates;

```
WrapVar = {
0 if uncertainNumWraps = false
(360 / averageDiffP)^2 if uncertainNumWraps = true
}
uncertainNumWraps = true if there have been any changes in
toolface between samples during the slide
varFactor = 1.5 (determined heuristically)
```

Sliding Efficiency is a measure of the consistency of the toolface during the slide. For example, if the toolface is determined to have had roughly the same value for the entirety of the slide, then Sliding Efficiency may be set to 1. If, on the other hand, the toolface is determined to have varied roughly randomly for the entirety of the slide, then Sliding Efficiency may be set to 0. Therefore, reactive torque processor 213 may adjust the value of Sliding Efficiency based on the degree of variance of the toolface during the slide. If, at any point during the slide, reactive torque processor 213 is unsure as to the direction in which the toolface has changed, then reactive torque processor 213 may be configured to add 360 degrees worth of variance to the measurement variance parameter for that slide. After having determined the measurement variance parameter, the measurement variance parameter is input to the Kalman filter.

At block 618, based on the reactive torque factor estimates and associated measurement variance parameters input to the Kalman filter, reactive torque processor 213 is able to determine, using the Kalman filter, an estimate of the relationship between the reactive torque factor and depth of the wellbore. The relationship between the reactive torque factor and depth of the wellbore can be noisy due to one or more factors. For example, any of following may affect the relationship:

- the initial torque stored in the system at the start of the slide (this may vary from slide to slide);
- instances in which reactive torque processor 213 incorrectly determines the direction in which the toolface has changed (for example, determining that the toolface has moved 160 degrees to the left when in fact the toolface has moved 200 degrees to the right);
- the potential non-linearity of the underlying process (for example, friction, mud properties, and motor wear can each cause non-linear effects);
- the fact that differential pressure readings tend to be noisy; and
- the fact that toolface is measured infrequently relative to differential pressure and top drive position, and readings are delayed as they must be sent from the downhole tool to surface.

At block 618, toolface controller 212 may use the determined relationship between the reactive torque factor and depth, as output by the Kalman filter, in order to control the toolface during a new sliding operation.

For example, toolface controller 212 may use ReactiveT_Factor when performing differential pressure compensation. When performing the differential pressure compensation operation, toolface controller 212 determines a difference between the current differential pressure and the differential pressure setpoint, as well as a rate of change of differential pressure relative to the differential pressure setpoint. Based on the difference between the current differential pressure and the differential pressure setpoint, as well as the rate of change of differential pressure relative to the differential pressure setpoint, toolface controller 212 may adjust the top drive position setpoint. The amount by which the top drive position setpoint is adjusted may be of the form (DiffP−DiffP_Setpoint) *ReactiveT_Factor*Scaling_Factor. In addition, or alternatively, the amount by which the top drive position setpoint is adjusted may be of the form DiffP_Derivative*ReactiveT_Factor*Scaling_Factor.

Furthermore, toolface controller 212 may use ReactiveT_Factor when determining the total amount of rotation that is to be provided to drill string 118 when going to bottom. Additionally, toolface controller 212 may use ReactiveT_Factor when steering using differential pressure, and when ramping differential pressure for the purpose of increasing ROP. For example, for the purpose of steering, the magnitude of the adjustment to the differential pressure setpoint may be proportional to ReactiveT_Factor. Adjusting the differential pressure setpoint may result, for example, in adjustments to the position of a brake handle (in embodiments in which a band brake is being used) or adjustments to throttle, both of which may lead to increased WOB, increased differential pressure, and increased ROP.

Generally, depending on the depth of the current slide, the corresponding ReactiveT_Factor that should be used may be used to adjust one or more drilling parameter setpoints to assist in controlling the toolface, such as the differential pressure and top drive position setpoints.

Figure 7:
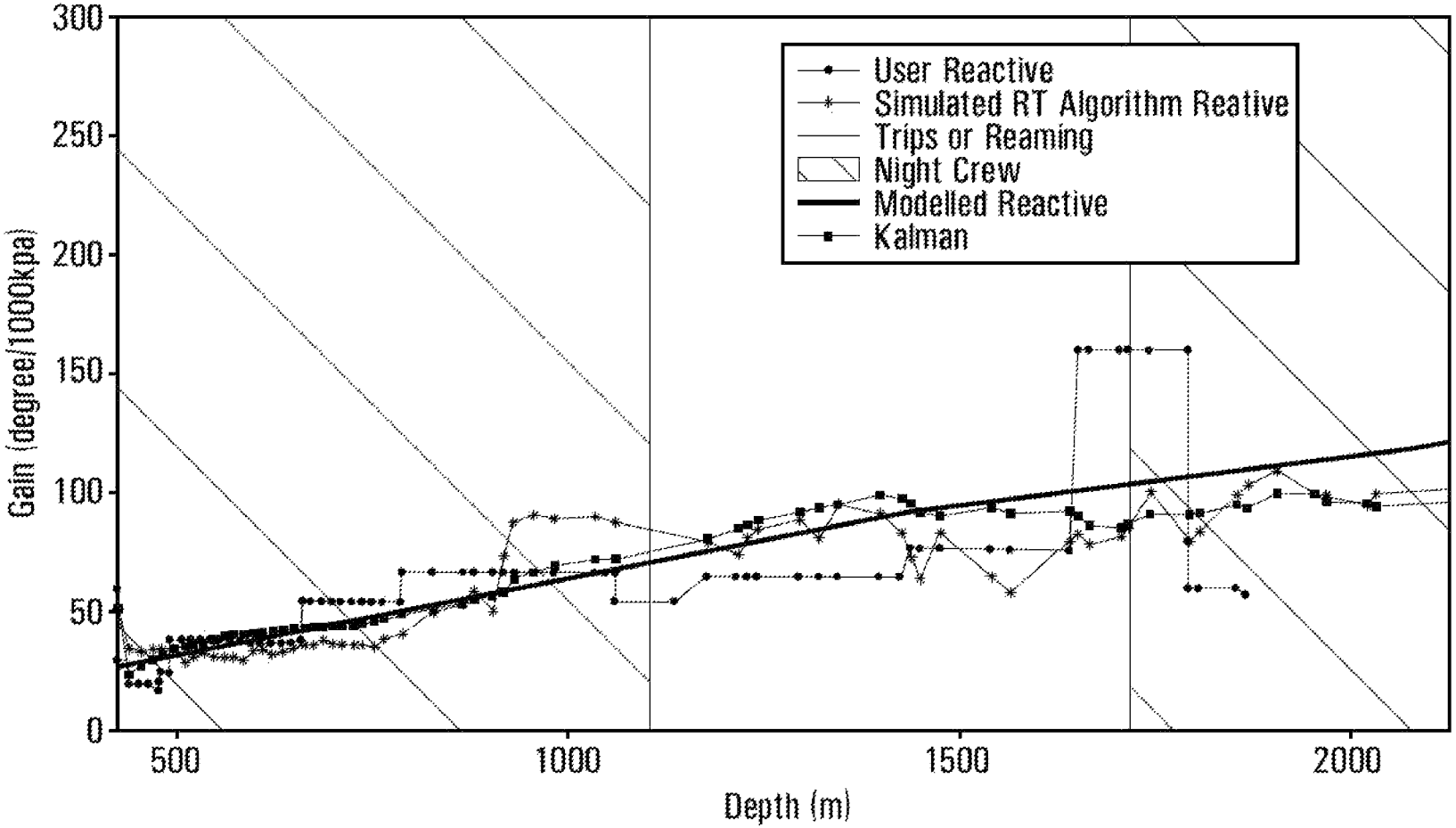
FIG. 7 is a plot showing unfiltered and filtered values of reactive torque factor as function of depth, according to embodiments of the disclosure.

Turning to FIG. 7, there is shown a plot displaying different traces of reactive torque factor as a function of depth. In particular, FIG. 7 shows:

- user-entered values of reactive torque factor ("User Reactive")
- simulated raw values of reactive torque factor ("Simulated RT Algorithm Reactive")
- simulated values of reactive torque factor using a Kalman filter ("Kalman")
- modelled values of reactive torque factor based on spring constant calculations ("Modelled Reactive")

Figure 8:
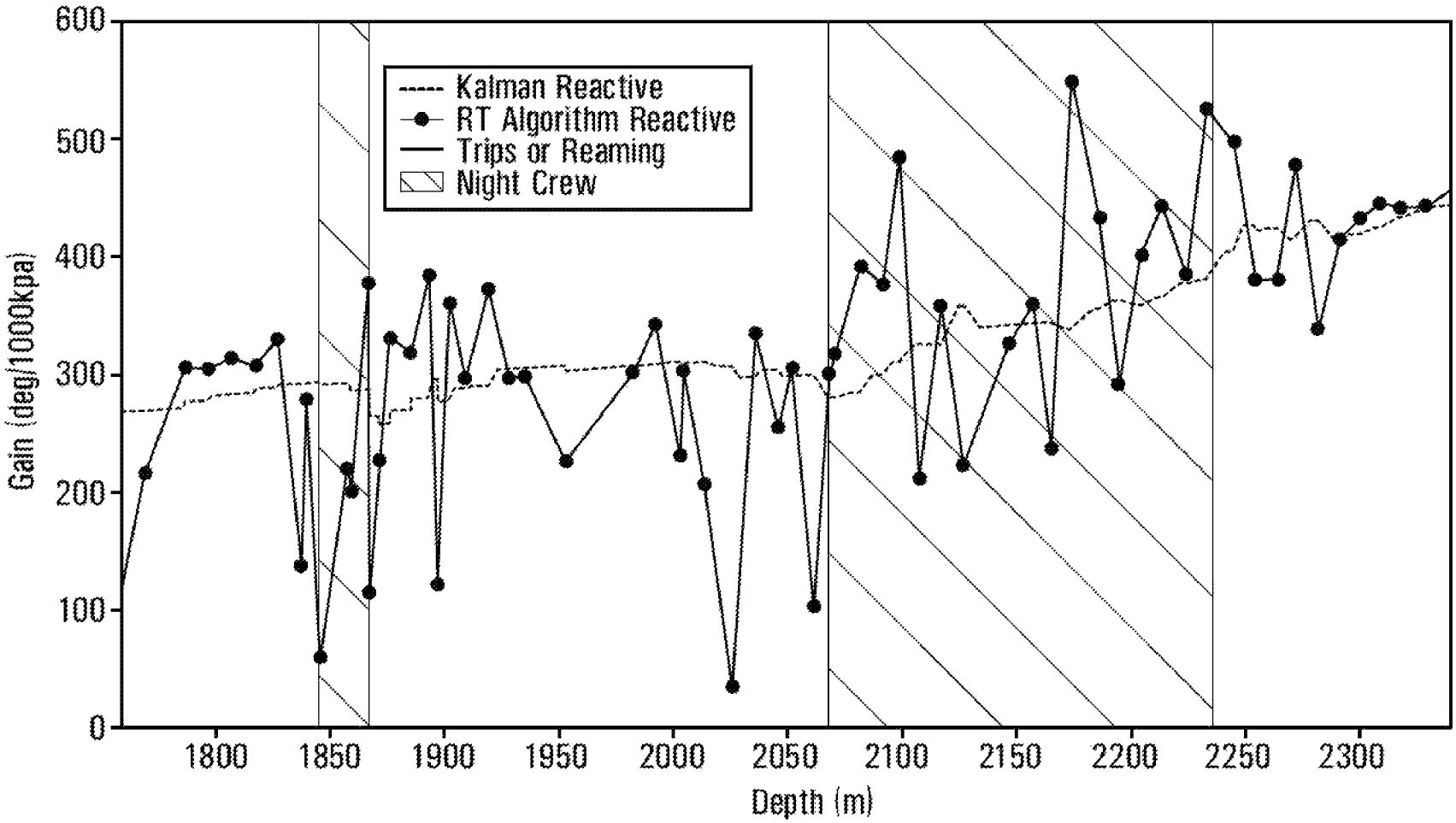
FIG. 8 is a plot showing unfiltered and filtered values of reactive torque factor as a function of depth, according to embodiments of the disclosure.

FIG. 8 shows data from a trial showing raw values of reactive torque factor and values of reactive torque factor smoothed using a Kalman filter according to the method described herein.

At the beginning of the drilling process, there is no data to be input to the Kalman filter, and therefore the reactive torque factor is unknown. Therefore, the Kalman filter can be initialized using one of three methods.

According to some embodiments, the driller may manually perform one or more initial slides. During these slides, reactive torque processor 213 continues to learn and update its estimate for the reactive torque factor, but the reactive torque factor is not used for toolface control purposes. Toolface controller 212 may then be turned on, and the reactive torque factor based on the data obtained from these initial slides may then be used for toolface control purposes.

Alternatively, the method of determining the reactive torque factor may be applied to past well data. For example, based on a similar well, the method of determining the reactive torque factor may be applied to the data obtained from that well. The resultant relationship that is determined between the reactive torque factor and depth may be used for the drilling of the new well.

Alternatively still, the drill string properties may be modelled, and the resultant reactive torque factor may be used for the initial estimate. For example, the drill string properties may be used to determine its spring constant, differential pressure may be converted to torque using one or more specifications of the mud motor being used, and then Hooke's law may be used to estimate the reactive torque factor.

If, over the course of the drilling operation, the mud motor is changed (for example due to a malfunction), then there may result a step change in the reactive torque factor due to a potential change in a torque to pressure ratio of the mud motor. In such cases, the Kalman filter is initialized using one of the three methods above.

The word "a" or "an" when used in conjunction with the term "comprising" or "including" in the claims and/or the specification may mean "one", but it is also consistent with the meaning of "one or more", "at least one", and "one or more than one" unless the content clearly dictates otherwise. Similarly, the word "another" may mean at least a second or more unless the content clearly dictates otherwise.

The terms "coupled", "coupling" or "connected" as used herein can have several different meanings depending on the context in which these terms are used. For example, the terms coupled, coupling, or connected can have a mechanical or electrical connotation. For example, as used herein, the terms coupled, coupling, or connected can indicate that two elements or devices are directly connected to one another or connected to one another through one or more intermediate elements or devices via an electrical element, electrical signal or a mechanical element depending on the particular context. The term "and/or" herein when used in association with a list of items means any one or more of the items comprising that list.

As used herein, a reference to "about" or "approximately" a number or to being "substantially" equal to a number means being within +/−10% of that number.

While the disclosure has been described in connection with specific embodiments, it is to be understood that the disclosure is not limited to these embodiments, and that alterations, modifications, and variations of these embodiments may be carried out by the skilled person without departing from the scope of the disclosure.

It is furthermore contemplated that any part of any aspect or embodiment discussed in this specification can be implemented or combined with any part of any other aspect or embodiment discussed in this specification.

The invention claimed is:

1. A method of determining a reactive torque factor for use in controlling a toolface of a downhole tool, comprising:

for each of one or more sliding operations, using one or more processors to:

(i) determine a change in a top drive position of a drive unit operable to rotate a drill string connected to the downhole tool;

(ii) determine a change in a toolface of the downhole tool;

(iii) determine a change in a differential pressure; and (iv) determine a reactive torque factor estimate based on the change in the top drive position, the change in the toolface, and the change in the differential pressure; and determining a relationship between the reactive torque factor and a depth of a wellbore through which the downhole tool is drilling, based on the reactive torque factor estimate determined for each sliding operation and based on a depth associated with each sliding operation, wherein determining the relationship between the reactive torque factor and the depth of the wellbore comprises:

inputting each reactive torque factor estimate to a Kalman filter; and determining, using the Kalman filter, the relationship between the reactive torque factor and the depth of the wellbore.

2. The method of claim 1, further comprising obtaining, from one or more drilling parameter sensors, one or more readings of the top drive position, the toolface, and the differential pressure, wherein (i)-(iv) are performed by the one or more processors receiving and processing the one or more readings.

3. The method of claim 1, wherein the one or more sliding operations comprise one or more previous sliding operations, and wherein the method further comprises, during a current sliding operation subsequent to the one or more previous sliding operations, adjusting one or more drilling parameter setpoints based on the one or more reactive torque factor estimates determined for the one or more previous sliding operations.

4. The method of claim 1, wherein one or more of:

the change in the top drive position is determined based on the top drive position at a start of the sliding operation;

the change in the toolface is determined based on the toolface at the start of the sliding operation; and the change in the differential pressure is determined based on the differential pressure at the start of the sliding operation.

5. The method of claim 1, wherein determining the change in the toolface comprises:

determining a steady state position of the toolface;

determining whether a magnitude of the change in the toolface is greater than a preset threshold; and based on whether the magnitude of the change in the toolface is greater than the preset threshold, determining whether the toolface has changed in a direction toward or away from the steady state position of the toolface.

6. The method of claim 1, wherein, for each of the one or more sliding operations:

(i)-(iv) are performed multiple times to thereby obtain multiple reactive torque factor estimates; and the method further comprises determining an average reactive torque factor based on the multiple reactive torque factor estimates.

7. The method of claim 6, wherein determining the average reactive torque factor comprises:

filtering the multiple reactive torque factor estimates based on whether or not:

one or more of the determined changes in the toolface are indicative of the toolface being at a steady state; or one or more of the determined changes in the differential pressure are indicative of the differential pressure being at a steady state.

8. The method of claim 1, wherein the one or more sliding operations comprise one or more previous sliding operations, and wherein the method further comprises, during a current sliding operation subsequent to the one or more previous sliding operations:

using the determined relationship to determine a reactive torque factor based on a depth associated with the current sliding operation; and adjusting one or more drilling parameter setpoints based on the determined reactive torque factor.

9. A computer-readable medium having stored thereon computer program code configured, when executed by one or more processors, to cause the one or more processors to perform a method of determining a reactive torque factor for use in controlling a toolface of a downhole tool, wherein the method comprises:

for each of one or more sliding operations:

(i) determining a change in a top drive position of a drive unit operable to rotate a drill string connected to the downhole tool;

(ii) determining a change in a toolface of the downhole tool;

(iii) determining a change in a differential pressure; and (iv) determining a reactive torque factor estimate based on the change in the top drive position, the change in the toolface, and the change in the differential pressure; and determining a relationship between the reactive torque factor and a depth of a wellbore through which the downhole tool is drilling, based on the reactive torque factor estimate determined for each sliding operation and based on a depth associated with each sliding operation, wherein determining the relationship between the reactive torque factor and the depth of the wellbore comprises:

inputting each reactive torque factor estimate to a Kalman filter; and determining, using the Kalman filter, the relationship between the reactive torque factor and the depth of the wellbore.

10. The computer-readable medium of claim 9, wherein the one or more sliding operations comprise one or more previous sliding operations, and wherein the method further comprises, during a current sliding operation subsequent to the one or more previous sliding operations, adjusting one or more drilling parameter setpoints based on the one or more reactive torque factor estimates determined for the one or more previous sliding operations.

11. The computer-readable medium of claim 9, wherein one or more of:

the change in the top drive position is determined based on the top drive position at a start of the sliding operation;

the change in the toolface is determined based on the toolface at the start of the sliding operation; and the change in the differential pressure is determined based on the differential pressure at the start of the sliding operation.

12. The computer-readable medium of claim 9, wherein determining the change in the toolface comprises:

determining a steady state position of the toolface;

determining whether a magnitude of the change in the toolface is greater than a preset threshold; and based on whether the magnitude of the change in the toolface is greater than the preset threshold, determining whether the toolface has changed in a direction toward or away from the steady state position of the toolface.

13. The computer-readable medium of claim 9, wherein, for each of the one or more sliding operations:

(i)-(iv) are performed multiple times to thereby obtain multiple reactive torque factor estimates; and the method further comprises determining an average reactive torque factor based on the multiple reactive torque factor estimates.

14. The computer-readable medium of claim 13, wherein determining the average reactive torque factor comprises:

filtering the multiple reactive torque factor estimates based on whether or not:

one or more of the determined changes in the toolface are indicative of the toolface being at a steady state; or one or more of the determined changes in the differential pressure are indicative of the differential pressure being at a steady state.

15. The computer-readable medium of claim 9, wherein the one or more sliding operations comprise one or more previous sliding operations, and wherein the method further comprises, during a current sliding operation subsequent to the one or more previous sliding operations:

using the determined relationship to determine a reactive torque factor based on a depth associated with the current sliding operation; and adjusting one or more drilling parameter setpoints based on the determined reactive torque factor.

16. A system comprising:

a drill string comprising a downhole tool at a downhole end thereof;

a drive unit operable to rotate the drill string; and a toolface controller for controlling a toolface of the downhole tool, the toolface controller comprising computer-readable memory and one or more processors, wherein the compute-readable memory comprises computer program code configured, when executed by the one or more processors, to cause the one or more processors to perform a method of determining a reactive torque factor for use in controlling the toolface of the downhole tool, and wherein the method comprises:

for each of one or more sliding operations:

(i) determining a change in a top drive position of a drive unit operable to rotate a drill string connected to the downhole tool;

(ii) determining a change in a toolface of the downhole tool;

(iii) determining a change in a differential pressure; and (iv) determining a reactive torque factor estimate based on the change in the top drive position, the change in the toolface, and the change in the differential pressure; and determining a relationship between the reactive torque factor and a depth of a wellbore through which the downhole tool is drilling, based on the reactive torque factor estimate determined for each sliding operation and based on a depth associated with each sliding operation, wherein determining the relationship between the reactive torque factor and the depth of the wellbore comprises:

inputting each reactive torque factor estimate to a Kalman filter; and determining, using the Kalman filter, the relationship between the reactive torque factor and the depth of the wellbore.

17. The system of claim 16, wherein the one or more sliding operations comprise one or more previous sliding operations, and wherein the method further comprises, during a current sliding operation subsequent to the one or more previous sliding operations:

using the determined relationship to determine a reactive torque factor based on a depth associated with the current sliding operation; and adjusting one or more drilling parameter setpoints based on the determined reactive torque factor.

18. The system of claim 16, wherein the method further comprises obtaining, from one or more drilling parameter sensors, one or more readings of the top drive position, the toolface, and the differential pressure, wherein (i)-(iv) are performed by the one or more processors receiving and processing the one or more readings.

19. The system of claim 16, wherein the one or more sliding operations comprise one or more previous sliding operations, and wherein the method further comprises, during a current sliding operation subsequent to the one or more previous sliding operations, adjusting one or more drilling parameter setpoints based on the one or more reactive torque factor estimates determined for the one or more previous sliding operations.

20. The system of claim 16, wherein one or more of:

the change in the top drive position is determined based on the top drive position at a start of the sliding operation;

the change in the toolface is determined based on the toolface at the start of the sliding operation; and the change in the differential pressure is determined based on the differential pressure at the start of the sliding operation.

21. The system of claim 16, wherein determining the change in the toolface comprises:

determining a steady state position of the toolface;

determining whether a magnitude of the change in the toolface is greater than a preset threshold; and based on whether the magnitude of the change in the toolface is greater than the preset threshold, determining whether the toolface has changed in a direction toward or away from the steady state position of the toolface.

22. The system of claim 16, wherein, for each of the one or more sliding operations:

(i)-(iv) are performed multiple times to thereby obtain multiple reactive torque factor estimates; and the method further comprises determining an average reactive torque factor based on the multiple reactive torque factor estimates.

* * * * *